US005936134A

United States Patent [19]

Mastral Lamarca et al.

[11] Patent Number: 5,936,134

[45] Date of Patent: Aug. 10, 1999

[54] METHOD FOR OBTAINING STORABLE PRODUCTS OF CALORIFIC ENERGY AND SYNTHETICAL OILS, BY PROCESSING WASTE RUBBER MATERIALS WITH COAL

[75] Inventors: Ana María Mastral Lamarca; Ramón Murillo Villuendas, both of Zaragoza, Spain

[73] Assignee: Consejo Superior Investigaciones Cientificas, Madrid, Spain

[21] Appl. No.: 08/824,297

[22] Filed: Mar. 26, 1997

[51] Int. Cl.[6] ..... C07C 1/00; C10G 1/00; C10G 1/10

[52] U.S. Cl. ..... 585/241; 585/357; 585/408; 585/638; 585/733; 208/15; 208/400; 208/424; 208/428; 208/429; 208/435

[58] Field of Search ..... 585/241, 240, 585/357, 408, 638, 733; 208/15, 16, 45, 96, 400, 424, 427, 428, 429, 435; 201/21

[56] References Cited

U.S. PATENT DOCUMENTS

| | | | |
|---|---|---|---|
| 4,077,866 | 3/1978 | Owen et al. | 208/9 |
| 4,303,497 | 12/1981 | Mitchell et al. | 208/10 |
| 5,061,363 | 10/1991 | Farcasiu et al. | 208/419 |

OTHER PUBLICATIONS

Warren et al. (1995) Viability of Co–Liquefying coal and Plastic wastes, Am. Chem. Soc., Div. Fuel Chem., vol. 40 p. 24–28.

Anderson et al. (1993) Am. Chem. Soc., vol. 38, p. 818–822.

Conesa et al. (1994) In: Energy and Fuels, vol. 8, p. 1238–46.

Taghiei et al. (1994) Energy and Fuels 8:1228–32.

Williams et al. (1993) Proc. Inst. Mech. Eng. 207:55–63.

Liu et al. (1994) In: Energy and Fuels, vol. 8, p. 607–12.

*Primary Examiner*—Bekir L. Yildirim
*Attorney, Agent, or Firm*—Klauber & Jackson

[57] ABSTRACT

A method for producing synthetical oils and storable products of calorific energy, by co-processing waste rubber materials, especially waste tires, and coal optionally in the presence of a material containing Fe as a catalyst, comprising the steps of mixing triturated waste rubber material having a particle size of preferredly 1–5 mm, and coal having particle sizes of 0.2–1 mm, and, when used, the catalyst having a referred particle size of 0.05–0.015 mm, until obtaining a mixture, heating the mixture in a reactor to a temperature between 300° C. and 500° C., during 3–180 minutes, at a pressure between atmospheric pressure and 10 MPa, to enable a processing step basically consisting of a pyrolysis/hydropyrolysis. During the processing step, there is a generation of gases containing approximately 50% CO and $CO_2$, and approximately another 50% by volume of $C_1$–$C_4$ hydrocarbons, and having a calorific energy between 6000 and 8000 kcal/$Nm^3$, the gases being collected whereas the material resulting from the reaction is a mixture of solids and liquids which is subjected to extraction with organic solvents whereby an extract and a solid first residue are obtained, the solid first residue having a calorific energy between 4500 and 5000 kcal/kg, whilst by subjecting the extract to fractionation, an asphaltene residue having high calorific energy as well as synthetic oils are obtained from the extract.

39 Claims, 1 Drawing Sheet

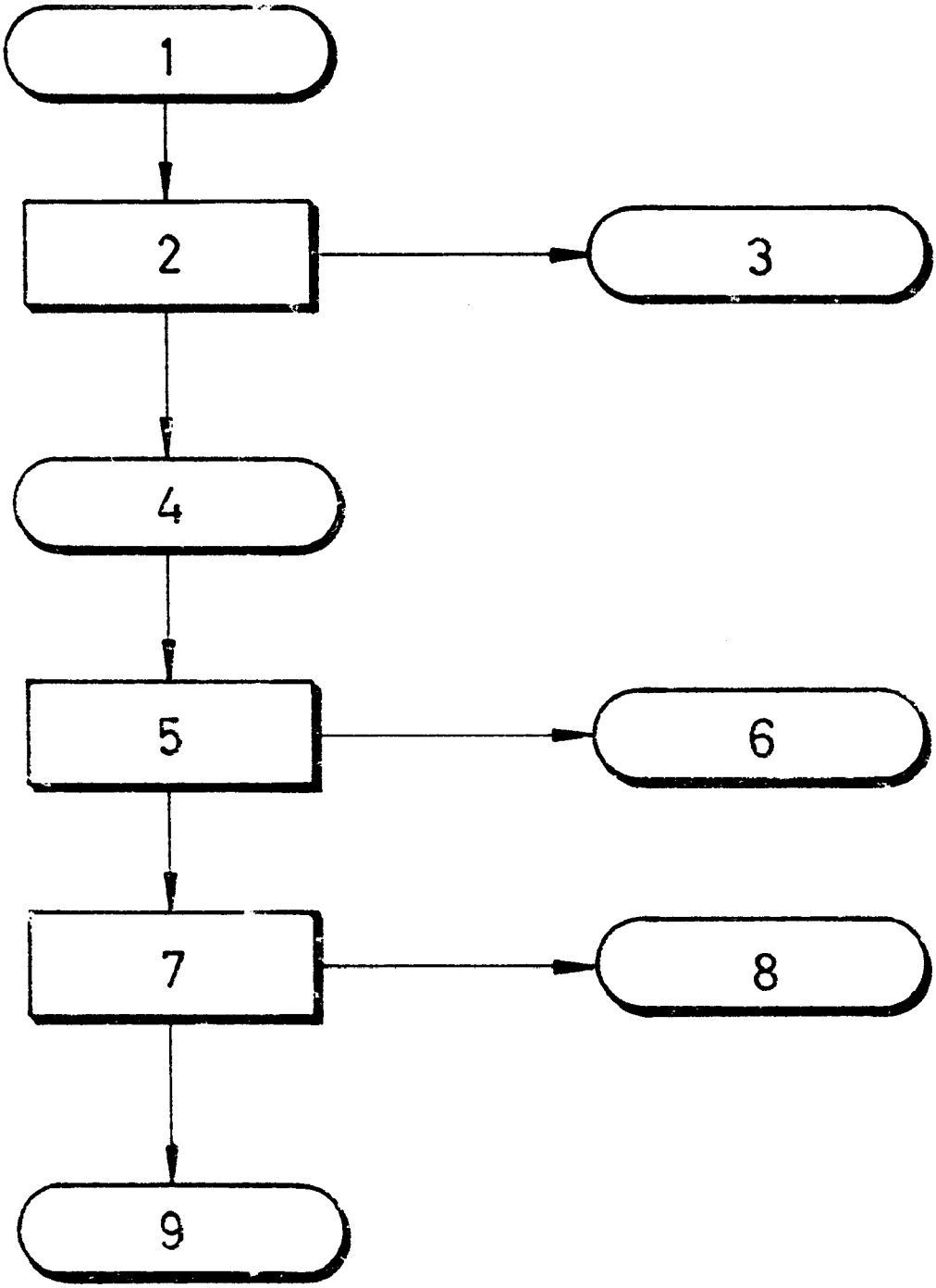
1
2
3
4
5
6
7
8
9

METHOD FOR OBTAINING STORABLE PRODUCTS OF CALORIFIC ENERGY AND SYNTHETICAL OILS, BY PROCESSING WASTE RUBBER MATERIALS WITH COAL

BACKGROUND OF THE INVENTION

1. Field of the Invention

The invention relates to reprocessing of non-biodegradable materials and particularly to reprocessing of rubber containing material. More particularly the invention relates to reprocessing rubber materials, especially waste tires, by a heat treatment and using a proportion of coal and, optionally, a catalyst.

2. Description of Prior Art

In the past years environmental provisions have become increasingly restrictive with regard to the littering and processing of non-biodegradable waste materials. The restrictions have lead to an increasing interest in reprocessing and recycling waste materials as plastics, paper, rubber and other combustible materials, into new, re-usable and valuable materials and products, instead of simply burning such waste materials as done throughout many decades.

Rubber-containing waste materials and especially tires, arise in enormous quantities and a large if not major portion thereof is at present still being simply littered or burned, whereby, environmental damages are caused and potentially valuable components are not recovered.

A way of reprocessing plastics, paper, rubber and other substantially combustible materials which is becoming of increasing interest, is related to coprocessing these materials with coal. An overview of such coprocessing methods is given in "Co-Utilization of Coal and Waste Materials"; American Chemical Society (ACS), Division of Fuel Chemistry; Vol. 40, 1 (1995).

Various systems for co-processing coal with waste materials are available at present. Thus, Huggins et al.; Energy and Fuels, vol. 8, page 1228 (1994) have described a method according to which waste plastic from juice bottles, milk bottles and other similar materials, are processed by coal liquefaction, whereby oils are obtained. Similar methods using coal liquefaction to obtain synthetic oils from co-processing waste tires and coal, are described by Anderson et al.; ACS; Vol. 38, 3 (1993) and in U.S. Pat. No. 5,061,363.

Another method, by which carbon and rubber are liquefied in the presence of a solvent and resulting in acceptable yields in synthetic oils, has been described by Liu et al., Energy and Fuels; Vol. 8, 607 (1994).

Methods according to which waste materials are subjected to pyrolysis have been described by Williams et al.; Proceeding of the Institution of Mechanical Engineers, Part C, 55, 207 (1993) relating to the economic aspects of the subjecting waste tires to pyrolysis, and by Font et al.; Energy and Fules, Vol. 8, page 1238 (1994) referring to pyrolysis of plastics in an inert atmosphere.

The hereabove mentioned known methods for processing waste rubber materials and especially waste tires have not been entirely satisfactory inasmuch they require relatively high inputs of energy or, especially in the case of coal-liquefaction based processes, are rather complex.

SUMMARY OF THE INVENTION

It is an object of the instant invention, to overcome the inconveniences of conventional methods of processing waste tires and other rubber waste materials, by providing a method, does not only yield satisfactory amounts of synthetic oil, but also other storable products of high calorific energy which may be used used as fuel in some combustions.

It is also an object of the invention, to obtain good yields in synthetic oils and in storable products of high calorific energy in methods where waste rubber materials, especially tires, are co-processed with coal whereby the products of high calorific energy are usable to heat the co-processing reaction and/or stored to be used in other combustions processes.

It is a another object of the invention, to provide a coal/waste rubber or waste tire co-processing method which can be performed in a simple manner without excessive investments in installations.

A further object of the invention is to provide a coal/waste rubber or waste tire co-processing method resulting in a satisfactory energy input/output balance.

It is yet another object of the invention to provide a new type of catalyst being unexpensive, readily available, and substantially harmless from an environmental viewpoint, as well as rendering coal/waste rubber or waste tire co-processing method simple and substantially unexpensive as well as capable of effectively reducing the hydrogen sulfide in the gases formed during the reaction.

DESCRIPTION OF THE INVENTION

The aforementioned objects are achieved by a method for producing synthetic oils and storable products of calorific energy, by co-processing waste rubber materials, especially waste tires, and coal, optionally in the presence of a material containing Fe.

Particulary, the instant invention, reduces noxious effects on the environment, allows obtaining oils, gases and residue having considerable calorific energy and may be used for providing heat in the process.

The method comprises mixing triturated waste material and coal, having particle sizes from 0.1–5 mm, preferredly 0.1–1 mm for coal, and 1 mm–5 cm, preferredly 1–5 mm and still more preferredly 1–4.5 mm, for waste material, and optionally adding a catalyst of a Fe containing material, mixing the coal, waste material and, when present, the catalyst until obtaining a mixture.

The thus obtained mixture is heated in a reactor to a temperature between 300° C. and 500° C., preferredly between 350 and 450° C. and still more preferredly between 375 and 450° C., for 3–180 minutes, preferredly for 10–40 minutes and still more preferredly for 10–30 minutes, at a pressure between atmospheric pressure and 10 MPa, preferredly between 1 and 7.5 MPa. The pressure may also be comprised between 1–5 MPa.

During the processing step, gases containing approximately 50% by volume CO and $CO_2$, and approximately another 50% by volume of $C_1$–$C_4$ hydrocarbons are generated. The gases normally have a medium calorific energy between 6000 and 8000 kcal/$Nm^3$ and are withdrawn from the reactor, whereafter they may be stored in conventional manners as fuel for combustion processes. Gases may also be circulated to a conventional heat exchanging means so as to provide heat to the reaction. Moreover, a portion of the gases may be combusted as fuel for providing heat to the reaction.

When present, the Fe-catalyst contributes to decreased $H_2S$ emissions as it fixes sulfur as iron sulfides.

The material resulting from the reaction is a mixture of solids and liquids which is subjected to extraction with organic solvents whereby an extract and a solid first residue are obtained, the solid first residue having a calorific energy between 4500 and 5000 kcal/kg, with about 45% of C and 1% of H, whilst by subjecting the extract to fractionation, a second residue, substantially an asphaltene based residue having high calorific energy as well as synthetic oils are obtained from the extract. No additional residue is produced.

Fe-containing materials which are suitable as catalysts in the method of the invention are any Fe-containing materials containing Fe in any state of oxidation as for example $Fe^{2+}$ and/or $Fe^{3+}$. Preferred catalyst are materials such as dried red mud, being available in large quantities and at very low prices. The preferred particle sizes of the catalyst material range from 0.01 to 0.15 mm.

The reaction time depends on the temperature and coal/rubber material ratio.

The process can be carried out in conventional moved bed, fixed bed, fluidized bed, or other reactors supporting working temperatures and pressures as those of the instant process. In an embodiment of the invention, the extraction to which the material resulting from the process is subjected, when necessary and depending on the type of bed used, is a Soxleth extraction. Suitable organic solvents for the extraction are for example tetrahydrofurane (THF), dichlormethane, methanol, chloroform, ethanol, acetone, diethyl ether and other organic solvents. Preferred solvents are organic polar solvents with low boiling points.

The fractionating to which the extract is subjected may be a conventional method used in petrochemical industry according to which hexane is added.

The extract resulting from subjecting the material obtained by the reaction is the aforementioned solid first residue having a calorific energy between 4500 and 5000 kcal/kg, and is basically composed of about 45% C and 1% H. The first residue is normally present in a quantity of 40–55%, often of 45–50% by weight of the mixture initially fed to the reactor.

The Fe-catalyst may contain Fe in different states of oxidation as a catalytic precursor. Thereby, as an additional advantage to the catalyst being an unexpensive and readily available cracking catalyst material, the Fe precursor is transformed into iron sulfide whereby the contents of hydrogen sulfide ($H_2S$) in the gases generated by the reaction is reduced, as due to the temperature and to the partial pressure at $H_2S$, there is a reduction from the oxidized state to the sulfide state.

The second residue having high calorific energy fractionated from the extract, normally is an asphaltene residue and has a calorific energy of 6000–8000 kcal/kg and may be used as a solid fuel.

The synthetic oils obtained by fractionating the extract are mainly in the range of gasolines and kerosine and are useful as fuels and/or as chemicals.

According to the invention, the yield of synthetic oils ranges generally ranges from 10 to 50% by weight referred to the mixture initially fed to the reactor. Yields of about 25% are normally attained when following the method of the invention.

The coal used in the reaction may be low range or medium range coals, as well as some bitumious coals. Especially when low range coals having a high sulfur contents are used, the process can be carried out without the Fe-catalyst due to the presence of substantial proportions of pyrite ($S_2Fe$).

The presence of the Fe-catalyst is convenient mainly to bind sulfur and it contributes in fixing the oxygenated compounds in the coal. It has been observed that, when using an Fe-catalyst, the proportion of apolar oils among the mixture of synthetic oils obtained after fractionation is reduced, thereby rendering said mixture of synthetic oils more useful as fuels.

Preferred contents of Fe provided, range between 2 and 10% by weight of Fe with reference to the total weight of the coal/waste rubber mixture. In a still more preferred embodiment, the Fe contents is about 4–6%.

BRIEF DESCRIPTION OF THE DRAWING

In the drawing, there is shown an embodiment of the invention. It should be understood, however, that the invention is not limited to the precise arrangements and instrumentalities shown in the drawing which is a schematic flow-sheet of the method of the invention.

DETAILED DESCRIPTION OF A PREFERRED EMBODIMENT

In the drawing, the reference numbers have the hereafter identified meanings:

1. Initial mixture of coal+waste rubber or waste tires+Fe-containing catalyst material
2. Hydrogenation step
3. Gases having high calorific energy
4. Reaction product
5. Extraction step with organic solvent
6. First solid residue of medium calorific energy
7. Fractionating step
8. Second residue of high calorific energy
9. Synthetic oils Following the flow chart according to FIG. 1, the triturated mixture 1 comprised of coal, waste rubber or waste tires, and Fe-containing catalyst, is fed into a reactor 2 where a hydropyrolysis reaction at a temperature between 300° C. and 500° C., a pressure between 10 and 100 kg/cm$^2$, is carried out for a period of 3 to 180 minutes.

The aforecited reaction generates gases 3 of high calorific energy i.e. between 6000 and 8000 kcal/Nm$^3$, comprised of approximately 50% CO and $CO_2$, 50% of $C_1$–$C_4$ hydrocarbons and approximately 0.1% $H_2S$, the gases being withdrawn from the reactor 2. The reaction product 4 is withdrawn from the reactor 2 and subjected to an extraction 5 with organic solvents, whereby a solid first residue 6 of medium calorific energy and an extract are obtained. The extract 7 is subjected to a fractionating 7 step, whereby a second residue 8 of high calorific energy, and synthetic oils 9 are obtained.

EXPERIMENTAL PART

EXAMPLE 1

A subbituminious coal provenient of the mining area of Utrillas was grinded and sieved to particle sizes between 0.2 and 0.5 mm. A sample was analyzed on ash and moisture free (daf) basis with the following results: 48.79% C, 4.08% H, 5.68 & S and 0.78% N.

Waste tires were deprived of their steel and fiber components and the remaining material was triturated to a maximum particle size of 0.9 mm. 1.35 g of coal and 2.91 g of triturated waste tire material were mixed.

EXAMPLE 2

A portion of the mixture prepared in accordance with example 1 was mixed with red mud containing 23.5% by weight of Fe, present as $Fe^{3+}$. The Fe contents in the mixture was thus about 5% by weight referred to the organic material of the mixture of waste material and coal.

EXAMPLE 3

The mixture of example 2 was heated during 30 minutes at a temperature of 400° C., at a hydrogen pressure of 10kg/cm$^2$, in a tubular reactor type tubing bomb comprising mechanical stirring means, and having a volume of 160 ml.

Gases generated during the process were evacuated from the reactor and collected in a plastic container. After 30 minutes, heating was stopped and the reaction product withdrawn from the reactor.

The reaction product was subjected to reflux extraction with 250 ml of tetrahydrofurane during 8 hours, whereby an extract and a solid first residue in an amount of 49% by weight referred to the starting mixture were obtained.

The extract was subjected to fractionating by adding hexane to the solution and stirring during 12 hours, until a second residue and synthetical oils were obtained.

The gases generated during the process were collected and a sample thereof was analysed with regard to the composition of the gases by Gas Chromatography.

The reaction product was measured as to the amount produced, and a sample thereof was analysed with a Hewlett Packard 5890 series gas chromatograph provided with a Poropak N column.

The solid first residue was collected and measured as to the amount produced, and a sample thereof was analysed with regard to its composition by elemental analysis and calorific value.

The second residue was collected and measured as to the amount produced, and a sample thereof was also analysed with regard to its composition by elemental analysis and calorific value.

The extract was collected and measured as to the amount produced.

The synthetical oils were collected and measured as to the amounts produced, and a sample thereof was analysed with regard to its composition by hydrocarbon type distributions and simulated destination by GC.

The results of the aformentioned measured amounts and compositions are summarized in the hereafter appearing tables.

TABLE I

| Gases | |
|---|---|
| weight (g) | 0.93 |
| volume (l) | 0.52 |
| calorific energy | 7009 kcal/kg |
| basic composition (by volume): | |
| $CO + CO_2$: | 45% |
| $C_1$–$C_4$ hydrocarbons | 53% |
| $H_2S$ | 2% |

TABLE II

| Solid first residue | |
|---|---|
| weight (g) | 2.22 |
| percentage by weight of the starting mixture | 44.3% |

TABLE II-continued

| Solid first residue | |
|---|---|
| calorific energy | 4661 kcal/kg |
| basic composition | |
| C | 45% |
| H | 1% |

TABLE III

| Second residue | |
|---|---|
| weight (g) | 0.20 |
| percentage by weight of the starting mixture | 4% |
| calorific energy | 7704 kcal/kg |

TABLE IV

| Synthetic oils | |
|---|---|
| weight (g) | 1.34 |
| percentage by weight of the starting mixture | 26.7% |
| basic composition | |
| C | 88% |
| H | 8% |
| S | 2% |
| O | 2% |
| Fractions in the mixture: | |
| saturated oils | 18% |
| aromatic oils | 58% |
| polar oils | 23% |

EXAMPLE 4

Another portion of the mixture of example 1 i.e. a mixture without Fe-catalyst was subjected to the same process as that of example 3. The analysis of the fractions present in the mixture of synthetic oils obtained gave the following results:

| | |
|---|---|
| saturated oils | 11% |
| aromatic oils | 49% |
| polar oils | 39% |

As apparent when comparing the fractions of the mixtures of synthetic oils of examples 3 and 4, the use of red mud as Fe-catalyst advantageously results in a substantially lower proportion of polar oils.

We claim:

1. A method for producing synthetical oils and storable products of calorific energy, by co-processing waste rubber materials and coal, the method comprising the steps of a first step of mixing triturated waste rubber material having a particle size of 1–5 cm and coal having a particle size of 0.1–5 mm until obtaining a mixture, a second step of placing the mixture into a reactor, a third step of heating the mixture resulting from the second step in a reactor to a temperature between 300° C. and 500° C. for 3–180 minutes, at a pressure between atmospheric pressure and 10 Mpa, to obtain a reaction product, thereby generating gases;

a fourth step of evacuating gases generated during the third step, a fifth step of subjecting the reaction product to extraction with organic solvents whereby a solid first residue having a calorific energy between 4500 and 5000 kcal/kg and an extract are obtained, a sixth step of subjecting the extract to fractionation whereby a second residue having a calorific energy of 6000–8000 kcal/kg as well as synthetic oils are obtained from said extract.

2. A method according to claim 1, wherein the rubber material has a particle size of less than 5 mm.

3. A method according to claim 1, wherein the temperature in the third step is between 350 and 450° C.

4. A method according to claim 3, wherein the temperature in the third step is between 375 and 450° C.

5. A method according to claim 1, wherein the third step is carried out for 5–60 minutes.

6. A method according to claim 1, wherein the third step is carried out for 10–40 minutes.

7. A method according to claim 1, wherein the third step is carried out for 10–30 minutes.

8. A method according to claim 1, wherein pressure applied during the third step is comprised between 1 and 7.5 MPa.

9. A method according to claim 1, wherein the pressure applied in the third step is comprised between 1 and 5 MPa.

10. A method according to claim 1, wherein the gases generating during the third step have a calorific energy between 6000 and 8000 kcal/$Nm^3$.

11. A method according to claim 10, wherein the gases have a proportion of at least 40% by volume of $C_1$–$C_4$ hydrocarbons.

12. A method according to claim 1, wherein the gases collected in the fourth step are at least partially used to provide the heating in the third step.

13. A method according to claim 1, wherein the gases are at least partially combusted to provide heating in the third step.

14. A method according to claim 1, wherein the extraction in the fifth step is carried out at reflux and the organic solvent is selected from solvents being slightly polar and with a low boiling point.

15. A method according to claim 14, wherein the organic solvent is selected from tetrahydrofurane, dichlormethane, chloroform, acetone, methanol, ethanol, diethyl ether and mixtures thereof.

16. A method according to claim 1, wherein the fractionation is a conventional fractionation by hexane addition.

17. A method according to claim 1, wherein the second residue obtained in the sixth step is an asphaltene material having a calorific energy between 7600 and 7800 kcal/kg.

18. A method according to claim 1, wherein the synthetic oils obtained in the sixth step contain a major proportion of gasoline and kerosene.

19. A method according to claim 1, wherein the rubber waste material is a triturated waste tire material obtained by removing steel portions and fiber portions from waste tires, and triturating the remaining material from which steel and fiber portions have been removed.

20. A method according to claim 19, wherein the triturated waste tire material has a particle size comprised between 1 mm and 4.5 mm.

21. A method for producing synthetic oils an atrable products of calorific energy, by co-processing waste rubber materials and coal in the presence of a catalyst, the method comprising the steps of A first step of mixing triturated waste rubber material having a particle size of 1–5 cm and coal having a particle size of 0.1 to 5 mm, a second step of adding an iron containing catalyst comprising an iron oxide, an iron sulfate, an iron sulfide, red mud, or a mixture thereof, in a proportion by weight of Fe comprised between 2 and 10% of the mixture resulting from the first step, mixing the coal, rubber waste material and catalyst until obtaining a structure, and placing the mixture into a reactor, a third step of heating the mixture resulting from the second step in the reactor to a temperature of between 300° C. and 500° C., during 3–180 minutes, at a pressure between atmospheric pressure and 10 Mpa, to obtain a reaction product, thereby generating gases a fourth step of evacuating gases generated during the third step, a fifth step of subjecting the reaction product to extraction with organic solvents whereby a solid first residue having a calorific energy between 4500 and 5000 Kcal/kg and an extract are obtained, a sixth step of subjecting the extract to fractionation whereby a second residue having a calorific energy of 6,000 to 8,000 kcal/kg as well as synthetic oils are obtained from said extract.

22. A method according to claim 21, wherein the rubber material has a particle size of less than 5 mm.

23. A method according to claim 21, wherein the temperature in the third step is between 350 and 450° C.

24. A method according to claim 23, wherein the temperature in the third step is between 373 and 450° C.

25. A method according to claim 21, wherein the third step is carried out for 5–60 minutes.

26. A method according to claim 21, wherein the third step is carried out for 10–40 minutes.

27. A method according to claim 21, wherein the third step is carried out for 10–30 minutes.

28. A method according to claim 21, wherein pressure applied during the third step is comprised between 1 and 7.5 Mpa.

29. A method according to claim 21, characterized in that the Fe-containing catalyst used therein is added in the second step in a proportion comprised between 4 and 6% by weight based on metallic Fe, referred to the total weight of coal and waste rubber mixture.

30. A method according to claim 21, wherein the gases generated during the third step have a calorific energy between 600 and 8000 kcal/$Nm^3$.

31. A method according to claim 21, wherein the gases collected in the fourth step are at least partially used to provide the heating in the third step.

32. A method according to claim 21, wherein the gases are at least partially combusted to provide heating in the third step.

33. A method according to claim 21, wherein the extraction in the fifth step is carried out at reflux and the organic solvent is selected from solvents being slightly polar with a low boiling point.

34. A method according to claim 33, wherein the organic solvent is selected from tetrahydrofuran, dichloromethane, chloroform acetone, methanol, ethanol, diethyl ether, and mixtures thereof.

35. A method according to claim 21, wherein the fractionation is a conventional fractionation by hexane addition.

36. A method according to claim 21, wherein the second residue obtained in the sixth step is an asphaltene material having a calorific energy between 7600 and 7800 kcal/kg.

37. A method according to claim 21, wherein the synthetic oils obtained in the sixth step contain a major portion of gasoline and kerosene.

38. A method according to claim 21, wherein the rubber waste material is i triturated waste tire material obtained by removing steel portions and fiber portions from waste tires, and triturating the remaining material from which steel and fiber portions have been removed.

39. A method according to claim 38, wherein the triturated waste tire material has a particle size comprised between 1 mm and 4.5 mm.

* * * * *